US005967818A

United States Patent [19]

Carron et al.

[11] Patent Number: 5,967,818

[45] Date of Patent: Oct. 19, 1999

[54] ELECTRICAL DISTRIBUTION DUCT WITH TRANSMISSION BUS

[75] Inventors: Jean-Claude Carron, Dijon; Gérard Jego, Brazey en Plaine; Jean-Pierre Thierry, Arc-sur-Tille, all of France

[73] Assignee: Schneider Electric SA, Boulogne Billancourt, France

[21] Appl. No.: 08/992,469

[22] Filed: Dec. 17, 1997

[30] Foreign Application Priority Data

Dec. 17, 1996 [FR] France ..... 96 15623

[51] Int. Cl.[6] ..... H01R 25/16

[52] U.S. Cl. ..... 439/211

[58] Field of Search ..... 439/417, 404, 439/211, 2.3, 6.95, 342, 350–356

[56] References Cited

U.S. PATENT DOCUMENTS

| | | | |
|---|---|---|---|
| 4,954,098 | 9/1990 | Hollingsworth et al. | 439/350 |
| 5,064,380 | 11/1991 | Dale et al. | 439/113 |
| 5,306,177 | 4/1994 | Burke et al. | 439/395 |
| 5,562,478 | 10/1996 | Yamamoto | 439/417 |
| 5,595,498 | 1/1997 | Jego et al. | 439/342 |
| 5,662,491 | 9/1997 | Antilla et al. | 439/342 |
| 5,759,065 | 6/1998 | Hatagishi et al. | 439/404 |

FOREIGN PATENT DOCUMENTS

| | | |
|---|---|---|
| 0 670 197 | 9/1995 | European Pat. Off. . |
| 0 673 089 | 9/1995 | European Pat. Off. . |

*Primary Examiner*—Michael L. Gellner
*Assistant Examiner*—Briggitte R. Hammond
*Attorney, Agent, or Firm*—Oblon, Spivak, McClelland, Maier & Neustadt, P.C.

[57] ABSTRACT

Electrical distribution duct with a signal transmission bus. Two bus connection parts that can be coupled with each other and associated with the support and the connector, respectively, are provided at branch connection support distributed along the duct. The connection part associated with the support includes two elastic contacts arms, built into an insulating body, to connect to each bus wire. Thus there are two contact points for each bus wire located at the ends of arms that come into contact with a rigid contact area laid out on a tab of the connector inserted in a support slot.

6 Claims, 2 Drawing Sheets

ELECTRICAL DISTRIBUTION DUCT WITH TRANSMISSION BUS

BACKGROUND OF THE INVENTION

1. Field of the Invention

This invention relates to an electrical distribution duct containing electrical power distribution conductors and a two-wire electrical communication signal transmission and/or control bus, hereinafter also referred to as low level signals, within a casing.

2. Discussion of the Background

This type of duct generally includes branch supports located at regular intervals along and inside the casing, facing appropriate openings so that a power and control connector can be connected to each. This connector is itself connected to an electrical appliance drawing power such as a load that must be powered from the power conductors, and with which it is required to exchange low level signals.

A duct of this type is described in document EP-673 089. It includes two bus connection parts at each branch support, associated with the support and with the connector respectively, and mechanically and electrically coupled together to form the communication and/or control link between the bus and the load connected to the connector.

There is no doubt that in the difficult environment of a power duct, robustness and contact quality are essential qualities required for connection of a bus, particularly a twisted pair or another two-wire bus.

SUMMARY OF THE INVENTION

The purpose of the invention is to improve the quality and reliability of the low level signal transmission bus connection at the location of the branch supports of the type of duct mentioned above.

According to the invention, the connection part associated with the support (or the connector) has two elastic contact branches built into an insulator body for connection to each wire on the bus, whereas the connection part associated with the connector (or support) has a rigid contact area on which the contact areas of the two elastic branches, projecting beyond the insulating body, come into contact.

Preferably, the connection part associated with the support includes folded conducting parts, each equipped at one end with at least one contact fork designed to displace the insulation and fit onto one of the bus wires, and at the other end a leg folded back on itself to form elastic branches with contact areas, these areas being offset parallel and perpendicular to the length of this duct.

The connection part associated with the connector may fit into a specific slot on the support and for each conductor to be connected, and include a metal connection branch that extends along the direction in which the connector is inserted, whereas an insulating strip is insert-molded on the connection arms, this strip being thin in the direction perpendicular to the length of the duct and the direction of insertion.

The following description applies to a non-restrictive example embodiment, with reference to the drawings in the appendix, and explains the advantages and results obtained by using the invention.

DESCRIPTION OF THE PREFERRED EMBODIMENTS

Figure 1:
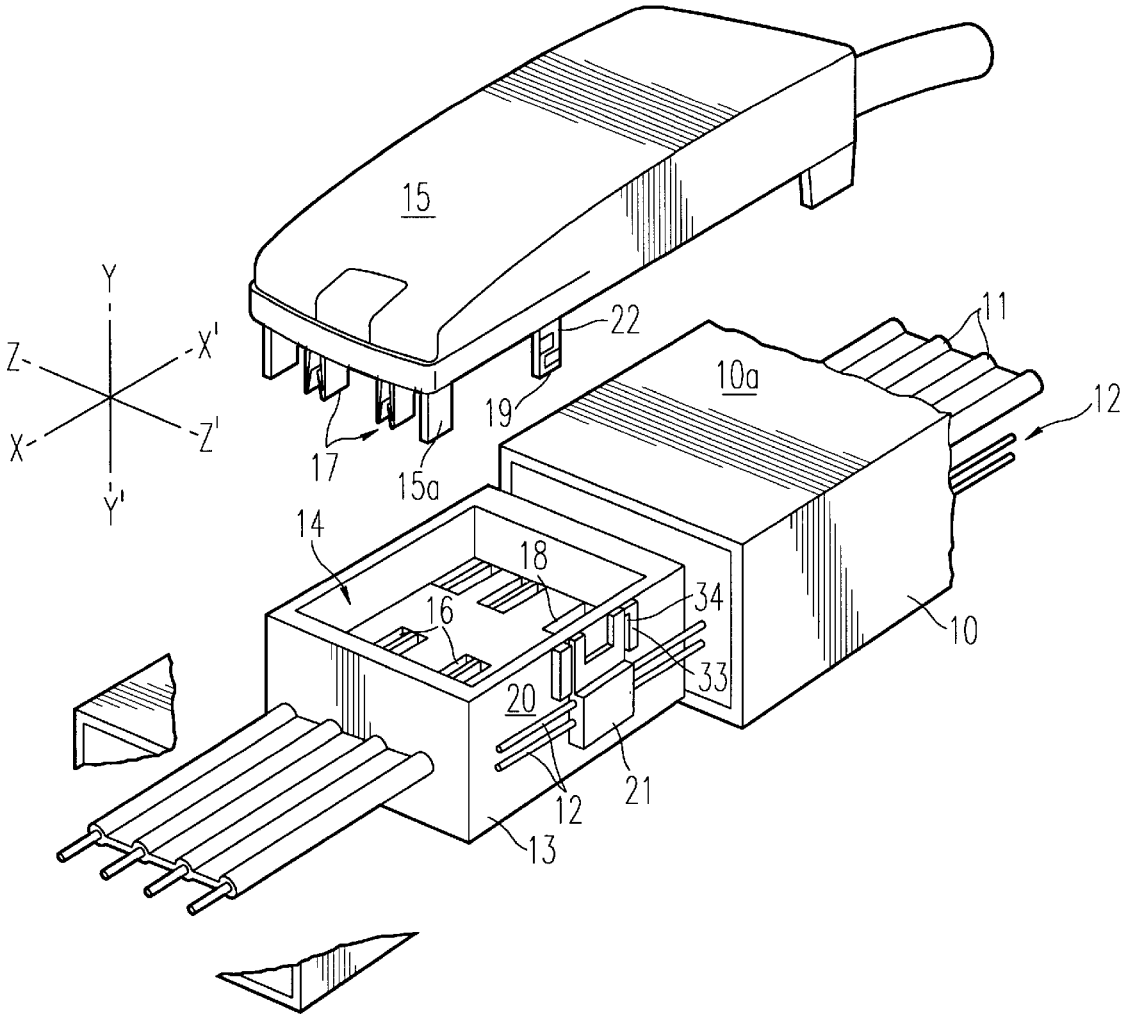
FIG. 1 shows a schematic perspective of an electrical duct according to the invention.

The electrical distribution duct shown in FIG. 1 includes a profiled metal casing 10, for example extruded, containing parallel conductors, namely electrical power conductors 11, either single conductors or in the form of a strip cable or possibly rods, and low level data, control or instrumentation signal transmission conductors 12; in this case the conductors 12 are in the form of a twisted or untwisted two-wire bus.

The duct extends along a longitudinal direction X–X' and includes fixed branch connection supports 13 made of an insulating material, at regular intervals; these supports are built into the casing so that each includes an opening 14 formed in a longitudinal face 10*a* of the casing for slots 16, 18 through which along connection plugs specific to branch connector 15 are inserted in a direction Y–Y' perpendicular to X–X'. There are slots 16 into which the power connector connection plugs 17 fit, and a slot 18 into which a pin 19 forming a signal connection part 22 fits, the plugs and the pin being oriented along Y–Y'.

A connection part 21 is fixed by penetration and/or click fitting on a side of support 20, and this connection part is connected on wires 12 so that it is connected to the wires by means of displacing or penetrating the insulation. The pin 19 forming part 22 projects along the Y–Y' direction under the body of connector 15.

Figure 2:
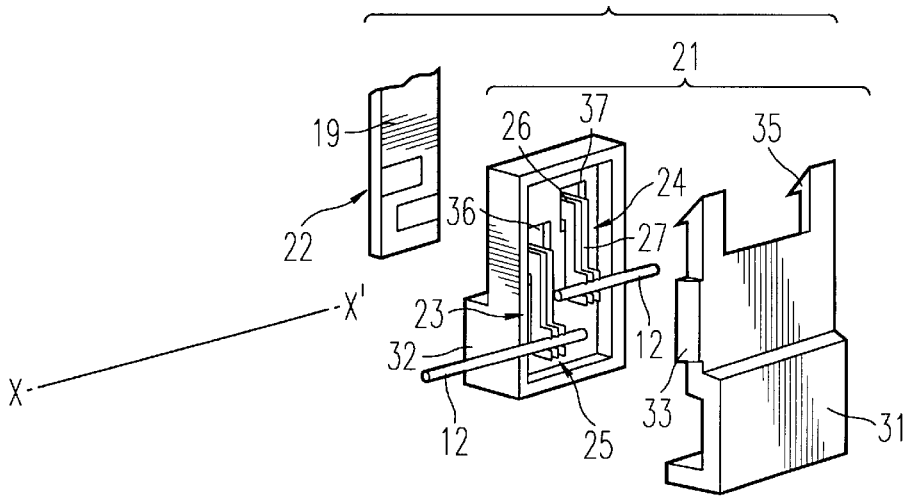
FIG. 2 shows a partially exploded perspective of the connection part associated with the support and the connection part associated with the branch connector in the duct in FIG. 1.
Figure 3:
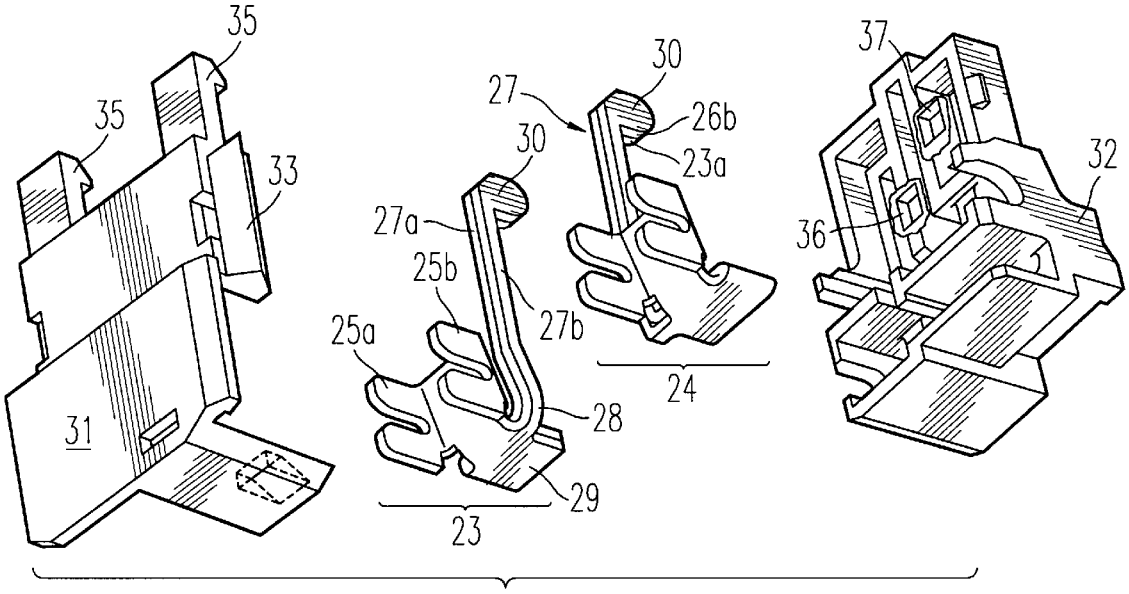
FIG. 3 is an exploded perspective view of the connection part associated with the branch connection support.
Figure 5:
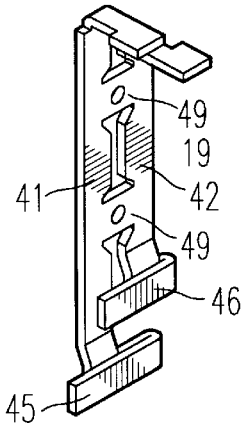
FIG. 5 shows the flat used to make the conducting part of the connection device shown in FIG. 4.
Figure 4:
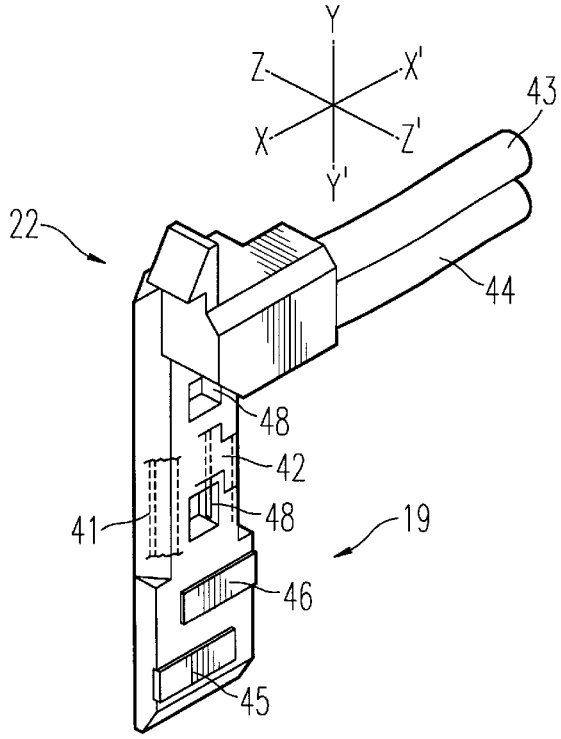
FIG. 4 shows a perspective of the connection device associated with the connector.

As can be better understood from in FIGS. 2 and 3, the connection part 21 associated with the support comprises two conducting parts 23, 24, each formed from a metal flat by cutting and folding; each part 23, 24 has two forks, 25*a*, 25*b* at one end, designed to push the insulation aside so that a wire 12 can fit at the bottom of the forks, and at the other end of the forks there are two contact areas 26*a*, 26*b* located in the end of the elastic arms 27*a*, 27*b* respectively. The arms, 27*a*, 27*b* are formed by bending back a leg 28 starting from a flat area 29 of the conducting part, and their main surfaces are in contact with each other. The contact areas 26 are formed by projecting parts 30 provided at the ends of arms 27, and their contact points are located on the edges of these projecting parts.

Conducting parts are symmetrical with respect to a plane perpendicular to X–X'. They are held between two insulating parts 31, 32 mutually assembled to form the body and connection part. Part 31 contains guide and retaining forms 33 in forms 34 complementary to the support sidewall 20 and elements 35 that click fit on the support. Part 32 includes openings 36, 37 through which the ends of arms 27 and their projecting parts 30 pass; they also pass through an opening in the sidewall support 20 to project into slot 18. Note that openings 36, 37 are mutually offset firstly along the longitudinal direction X–X', and secondly along the direction in which the connector Y–Y' is inserted.

The connection part 22 associated with the connector has two connection arms 41, 42 formed by folding and cutting a metal strip (5).

The side pieces 41, 42 are connected at one end to connector conductors 43, 44 connecting to the load, and at the other end are fitted with strips 45, 46 respectively, formed by folding the strip to be oriented along the X–X' direction, and designed so that each cooperates with the two contact areas 26*a,* 26*b* of a conducting part, 23, 24. The length of the strips 45, 46 is adapted to the amplitude of the displacement of the connector along X–X' when this type of movement is necessary to lock it. The strip 40 is insert-molded in an insulating strip 47 which is thin in the Z–Z' direction perpendicular to X–X' and Y–Y', so that it occupies a minimum space in the connector; the strip is then punched at 48 to cut the links 49 initially provided between side pieces 41, 42.

When connector 15 is inserted in the opening 14 in the duct casing along the Y–Y' direction, it is guided by tabs 15*a* oriented along the Y–Y' direction in slits (not shown) on support 13; the power plugs 17 oriented along the same direction fit into the slot 18 and the tab 19 fits into slot 18. When the conducting strips 45, 46 enter slot 18 at the projecting part 30 of arms 27, the two contact areas 26*a,* 26*b* of which project towards the inside of the slot, they fit onto these contact areas pushing them along the Z–Z' direction by bending arms 27. Note in this case that the connection quality is good and the connection is reliable.

We claim:

1. Electrical distribution duct, containing electrical power distribution conductors and an electrical communication or instrumentation signal transmission bus within a single casing, wherein branch connection supports thereof are placed at regular intervals along and inside the duct and facing appropriate openings so that each said support enables connection of a power and control connector for conductors connected to a load, first and second bus connection parts associated with the support and the connector respectively, being mechanically and electrically coupled to enable transmission of signals between the bus and the load, wherein said first connection part has two elastic contact arms built into an insulating body to connect to each wire in the bus, and said second connection part has rigid contact areas of said first connection part, each of which comes into contact with two contact areas, that project outside a portion of the isolating body.

2. The duct according to claim 1, wherein said first connection part includes conducting parts placed in the insulating body, said conducting parts being offset both parallel and perpendicular to a center line of the duct.

3. The duct according to claim 1, wherein the second connection part includes metal connection arms which extend along an insertion direction perpendicular to a length of the duct, and an insulating strip insert molded on the connection arms which is of reduced thickness along a direction perpendicular to the length of the duct and an insertion direction.

4. The duct according to claim 1, wherein the first connection part click fits on a side face of one of said supports by fitting onto said one of said supports in a direction parallel to the direction in which the connector is inserted in the support, the contact areas of elastic arms projecting through an opening in a support sidewall in a support slot to guide the second connection part.

5. The duct according to claim 1, wherein said first connection duct comprises conducting parts fitted at an end thereof with an insulation displacement fork that fits onto one of the bus, and wherein a leg folded back on itself is located an end thereof which forms the two elastic contact arms.

6. The duct according to claim 5, wherein the elastic arms are folded on a main surface portion thereof, wherein contact areas thereof are located at free ends projecting outside the body and at edge portions thereof.

* * * * *